US006267185B1

(12) United States Patent
Mougel et al.

(10) Patent No.: US 6,267,185 B1
(45) Date of Patent: Jul. 31, 2001

(54) APPARATUS AND METHOD FOR COMMUNICATION WITH DOWNHOLE EQUIPMENT USING DRILL STRING ROTATION AND GYROSCOPIC SENSORS

(75) Inventors: Bernard Mougel, Sugar Land; Remi Hutin, New Ulm, both of TX (US)

(73) Assignee: Schlumberger Technology Corporation, Houston, TX (US)

( * ) Notice: Subject to any disclaimer, the term of this patent is extended or adjusted under 35 U.S.C. 154(b) by 0 days.

(21) Appl. No.: 09/368,097

(22) Filed: Aug. 3, 1999

(51) Int. Cl.[7] ..... E21B 25/16; G01V 1/40

(52) U.S. Cl. ..... 175/57; 175/45

(58) Field of Search ..... 33/356, 361, 302, 33/304; 324/368, 207.26, 303; 702/9, 92, 94; 175/45, 40, 48, 61, 57, 73, 74

(56) References Cited

U.S. PATENT DOCUMENTS

| | | | | |
|---|---|---|---|---|
| 3,967,680 | | 7/1976 | Jeter . | |
| 4,647,853 | | 3/1987 | Cobern . | |
| 4,763,258 | | 8/1988 | Engelder . | |
| 4,909,336 | | 3/1990 | Brown et al. . | |
| 5,259,468 | * | 11/1993 | Warren et al. | 175/45 |
| 5,842,149 | * | 11/1998 | Harrell et al. | 702/9 |
| 5,850,624 | * | 12/1998 | Gard et al. | 702/92 |
| 6,021,377 | * | 2/2000 | Dubinsky et al. | 702/9 |
| 6,088,294 | * | 7/2000 | Leggett, III et al. | 367/25 |
| 6,092,610 | * | 7/2000 | Kosmala et al. | 175/61 |

OTHER PUBLICATIONS

Hamming, R.W., *Coding and Information Theory*, (Prentice–Hall, 1980). pp. 21–49.

* cited by examiner

*Primary Examiner*—Robert E. Pezzuto
(74) *Attorney, Agent, or Firm*—John J. Ryberg; Steven L. Christian; D. Delos Larson

(57) ABSTRACT

Apparatus and methods are utilized for controlling downhole equipment attached to a drill string by the transmission of commands from the surface of the earth. The drill string is rotated at the surface of the earth sequentially through one or more discrete angles of rotation to generate a command code. The sequence of discrete angular rotations is sensed downhole by a gyroscope and decoded as a command in a microprocessor. Alternately, a command code is transmitted by sequentially rotating the drill string at different angular rates which are likewise sensed by the gyroscope and decoded in the microprocessor. The microprocessor then transmits the decoded command to the controlled equipment.

23 Claims, 3 Drawing Sheets

APPARATUS AND METHOD FOR COMMUNICATION WITH DOWNHOLE EQUIPMENT USING DRILL STRING ROTATION AND GYROSCOPIC SENSORS

BACKGROUND OF THE INVENTION

This invention relates to the control of downhole equipment attached to a drill string by the transmission of commands from the surface of the earth. More particularly, the invention relates to a down link communication system for directional drilling and measurement-while-drilling (MWD) systems wherein commands are transmitted as defined rotations or rotation rates of the drill string implemented at the surface, sensed downhole by a gyroscopic sensor, and subsequently transmitted to the controlled downhole equipment.

Borehole drilling technology has advanced significantly during the past two decades. Advances have been particularly significant in the drilling of oil and gas wells. In offshore operations, it is not uncommon to drill dozens of boreholes from a single drilling platform location, where each borehole is directed to a specific target location. This practice is commonly referred to as "directional drilling", and requires that borehole paths be deviated from the vertical direction. The drilling of severely deviated and even horizontal wells has become a common practice used to maximize hydrocarbon production from a single borehole. Measures of geophysical parameters of formations penetrated by the drill bit are now made simultaneously with the drilling operation. These MWD measurements are used to "steer" the drill bit within the formation or formations of interest, and the technique is often referred to as "geosteering".

All of the above techniques require some type of communication between downhole equipment attached to the drill string and personnel or equipment at the surface of the earth. An "up link" communication system provides a means for transmitting downhole sensor response data to the surface. A "down link" communication system from the surface to the downhole equipment is used to control downhole equipment which, in turn, controls the path of the drilled borehole. Down link commands are also used to activate and deactivate various MWD sensors while the borehole is being drilled. During borehole workover operations, various types of downhole or bottom equipment are activated by down link signals from the surface. A down link communication or telemetry system suitable for all of these applications is set forth in this disclosure.

Most modem drilling systems use the circulation of drilling fluid or drilling "mud" as a method for removing drill cuttings, cooling and lubricating the drill bit, and controlling pressures of penetrated formations by providing a hydrostatic head within the borehole. Drilling mud is pumped downward through a string of drill pipe, exits the "drill string" at the bit, and returns to the surface for recirculation through the drill stringborehole annulus. Many prior art telemetry systems have used the mud column within the borehole as a physical channel for communicating with downhole equipment, as well as a physical channel for transmitting downhole sensor data to the surface. Stated briefly, the pressure generated by the mud pump is modulated in order to generate a pressure pattern in the mud column. For up link communication, modulation occurs downhole and the induced pressure pattern is sensed at the surface by a pressure sensor at the surface of the earth and subsequently decoded. For down link communication, modulation occurs at the surface and the pressure pattern is sensed by a pressure sensor or a flow sensor located within the downhole equipment and decoded downhole. This communication technique is not reliable, because variations in the mud column pressure can also be induced by changing environmental conditions such as varying pressures within penetrated formations.

U.S. Pat. No. 3,967,680 discloses a down link communication which utilizes controlled drill pipe rotation and controlled drilling mud flow rate changes to carry out various down hole operations. Commands are defined as a function of the rate of rotation of the drill string. The rate of rotation is sensed downhole by a device comprising a pair of rotatable fly weights attached to a lever apparatus, where the fly weight axis of rotation is coincident with the axis of rotation of the drill string. An increase in drill string rotation rate urges the fly weights outward due to an increase in centrifugal force, and a decrease in drill string rotation rate results in an inward movement of the fly weights due to a decrease in centrifugal force. The radial extension of the fly weights is, therefore, an indication of the rate of drill string rotation. The fly weights cooperate with a spring and actuator apparatus to perform defined downhole operations based upon the rate of rotation of the drill string. The operations are further defined by the mud pressure which is used to power the activator. The entire fly weight and actuator system is mechanically complex, and can be used only to sense the rate of drill string rotation, and not to sense incremental rotations of the drill string. Significant measurement error can also be expected in highly deviated boreholes and at slow drill string rotation rates due to the force of gravity perturbing the centrifugal force acting upon the fly weights.

Deviated wells are often drilled with a drilling system comprising a turbine or "mud motor" attached to the bottom of the drill string. The drill bit is attached to, and can be rotated by, the mud motor which is powered by mud pressure generated by the mud pump. The mud motor can be deactivated and the drill bit can be rotated by rotating the drill string. A deviated subsection or "bent sub" is positioned immediately uphole from the mud motor. When the direction of the bit path is to be changed, the drill bit is stopped and the entire downhole drilling assembly is redirected azimuthally by a controlled rotation of usually a few degrees of the drill string at the surface. The mud motor is again started, and the borehole is drilled in the new direction. U.S. Pat. No. 4,647,853 discloses a system for detecting the rate of rotation of a downhole turbine using a triaxial magnetometer, which is usually a "standard" component carried by deviated drilling systems and which is used in defining the location and orientation of the downhole drilling assembly. A powerful permanent magnet is mounted on the uphole end of the turbine drive shaft, with the magnetic moment of the magnet perpendicular to the axis of the turbine shaft. As the turbine shaft rotates, this turbine mounted magnet superimposes a rotating magnet field on the earth's magnetic field in the vicinity of the turbine. This superimposed rotating field constitutes a mud motor tachometer signal, which is sensed and separated from the response of the system's existing magnetometer. The signal defines the rotation rate of the mud motor turbine, and not the rate of rotation of the drill string. Furthermore, the system can be used only in "open" boreholes, since the magnetometer response is meaningless in boreholes cased with steel casing. The system is also insensitive to any type of incremental rotation.

U.S. Pat. No. 4,763,258 discloses methods and apparatus for telemetering while drilling by changing drill string rotation angle or drill string rotation rate or rotation "speed". The magnitude of an incremental rotation of the drill string is related to an arbitrary downhole function, such as the activation of a specific downhole sensor. The incremental rotation is sensed by a downhole inclinometer and magnetometer, which are normally carried by a deviated hole downhole drilling system to define the orientation and location of the downhole equipment. The outputs of the inclinometer and the magnetometer cooperate with a downhole microprocessor, which sends the signal to execute the sensed command. In another embodiment, the rate of drill string rotation is related to an arbitrary downhole function. The rate of rotation is again sensed by the magnetometer and inclinometer, and these outputs are converted to the defined command by means of the microprocessor. The system requires a three axis magnetometer and a three axis inclinometer. Although normally available with deviated drilling systems, this equipment might not be included in a "standard" package for other downhole operations as, for example, workovers. The response of the magnetometer can be affected by geophysical properties of the formation being penetrated by the drill bit. In addition, the technique is limited to use in open boreholes since the response of the magnetometer is meaningless in boreholes cased with the normal steel casing pipe.

A primary object of the present invention is to provide a down link communication system for operating downhole equipment which does not require a mud circulation system and which does not rely upon a mud column as a physical channel of communication.

Another object of the invention is to provide a down link communication system which can be operated in open boreholes and in boreholes cased with conventional steel casing.

Yet another object of the invention is to provide a standalone down link communication system which is applicable to numerous borehole operations, and which is not limited to use in MWD or drilling operations by requiring other downhole components utilized in MWD and/or directional drilling operations.

Still another object of the invention is to provide a cost effective down link communication system which maximizes the use of commercially available parts and minimizes the use of special, expensive, high maintenance components.

Another object of the invention is to provide an accurate down link communication system which incorporates methods for checking error associated with telemetered data.

Yet another object of the invention is to provide a telemetry system which is unaffected by geophysical properties of formations penetrated by the borehole.

There are other objects and applications of the present invention that will become apparent in the following disclosure.

SUMMARY OF THE INVENTION

The invention uses the rotation of the drill pipe as a physical channel for communicating from the surface to downhole equipment. In one embodiment, the rate of rotation of the drill pipe is used as a means for telemetering information downhole. A pattern of one or more sequential, incremental rotation rates is used to represent a specific command. In another embodiment, discrete, angular drill string rotations are used as a means for telemetering information. A pattern of preferably two or more sequential, incremental angular rotations is used as a means for telemetering information or "commands" for downhole equipment. The incremental rates of rotation, and the incremental angles of rotation are measured in the vicinity of the drill bit by means of a gyroscope or "gyro". The output of the gyro is input into a downhole microprocessor wherein the telemetered command is decoded and converted into a command recognized by equipment for a specific downhole operation.

The invention requires only a single axis gyro, with the axis aligned with the axis of the drill pipe. Such gyros are available commercially, physically compact, rugged and relatively inexpensive. It is well known in the art that gyros are designed to measure angle and angular rotation rate or angular speed. Similar measurements can be made with magnetometers and accelerometers, but these devices can also be affected by geophysical properties of formations being penetrated by the drill bit and environmental conditions such as steel casing in the borehole and the deviation of the borehole.

The encoding of a message or command to be telemetered can be based upon either a change in angular position, or alternately a change in rotational speed of the drill string induced at the surface and sensed downhole. The angular position can be adversely affected by the twisting of typically thousands of feet of drill pipe, especially in highly deviated wells where the friction between the drill pipe and the borehole wall is great. In these situations, the rotation speed of the drill string is a much more reliable means for telemetering because the rotation speed at the surface is equal to the rotation speed downhole, at least after a transitional period and when averaged over a few revolutions. Using either method of telemetry, it is highly preferred to telemeter while the drill bit is off of the bottom of the borehole in order to reduce the torque on the drill string and the associated drill pipe twisting.

When the angular position of the drill string is used for telemetry coding, a telemetered symbol is represented by a change in the angular position. As an example, a binary "1" can be represented by a discrete rotation or "shift" of 180 degrees (°) and a binary "0" can be represented by no shift at all. Alternately, a binary 1 can be represented by a clockwise shift of 90° and a binary 0 by a counterclockwise shift of 90°. A message consists of a sequence of different angular positions at different times. Other coding schemes can be used, as will be discussed subsequently, as long as they fall within the angular and time resolution of the system.

When using the rotation speed for encoding, a symbol is represented by a specified angular rotation speed, and a message consists of a sequence of different speeds at different times. As an example, a speed of 10 revolutions per minute (rpm) might represent a binary 0, and a speed of 20 rpm might represent a binary 1. As with the angular position coding scheme, other speed coding schemes can be used, as will be discussed subsequently, as long as they fall within the angular speed and time resolution of the system.

Using either the angular position or angular speed coding embodiment of the invention, a reasonable baud rate for this type of transmission is about one symbol every 30 seconds (sec.). A short command consisting of 5 useful bits (e.g. a specific device command) and 5 overhead bits (e.g. a device identifier, address, or error signal) can, therefore, be transmitted in about 5 minutes (min.).

The methods and apparatus of the invention are applicable for communicating from the surface to any downhole device which is attached to a rotatable drill string. The preferred embodiment encompasses directional drilling, MWD or logging-while-drilling (LWD) systems.

BRIEF DESCRIPTION OF THE DRAWINGS

So that the manner in which the above recited features, advantages and objects of the present invention are attained can be understood in detail, more particular description of the invention, briefly summarized above, may be had by reference to the embodiments thereof which are illustrated in the appended drawings.

It is to be noted, however, that the appended drawings illustrate only typical embodiments of the invention and are therefore not to be considered limiting of its scope, for the invention may admit to other equally effective embodiments.

DESCRIPTION OF THE PREFERRED EMBODIMENTS

The preferred embodiments of the invention will be disclosed in three sections. The first section will be directed toward apparatus. The second section will illustrate several different methods for transmitting commands to one or more downhole instruments in order to perform various mechanical and sensory functions. The third section will address means for verifying that proper commands have been received by the downhole system within predetermined error limits.

Figure 1:
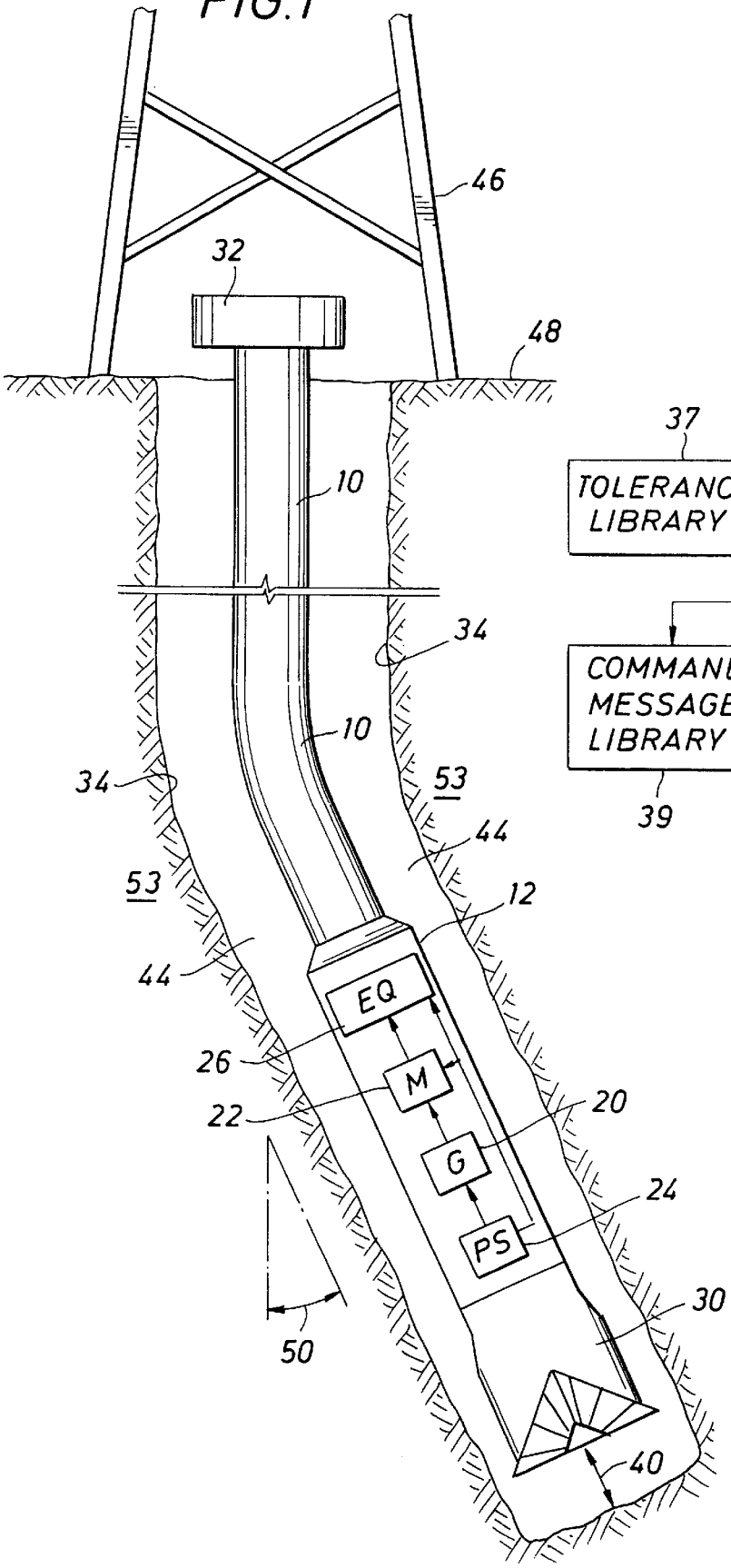
FIG. 1 shows the invention affixed to a drill string and suspended within a borehole.

Attention is directed to FIG. 1 which illustrates the invention in a borehole environment. A drill bit 30 is attached to a drill collar 12 which is suspended from attached sections or "stands" of drill pipe to form a drill string 10 within a borehole 34. The upper end of the drill string 10 terminates at the surface of the earth 48 in a drilling rig which comprises a derrick 46 which supports the drill string 10, and a kelly 32 which cooperates with a rotating table (not shown) and rotates the drill string 10. Other components of the drilling rig, such as the drilling mud circulation system, a motor for powering the kelly 32, and draw works for conveying the drill string into and out of the borehole 34 have been omitted from FIG. 1 for purposes of clarity. The borehole 34 can be vertical, or portions of the bore hole can be deviated from the vertical by an angle identified by the numeral 50. For definition, it is helpful to define the Z axis of the drill collar as the centerline of the collar, and the X and Y axis are at right angles in a transverse plane to the Z axis.

Still referring to FIG. 1, the drill collar 12 comprises a preferably single axis gyroscope (gyro) 20 with the axis of rotation coincident with the major axis of the drill collar 12. Gyro axis orientation can be coincident with the Z axis, or another selected axis so that the initial or beginning reference position is known. The gyro 20, which is powered by a power supply 24, senses both the azimuthal position of the drill collar 12 within the borehole 34 and the rate of rotation of the drill collar 12 resulting from the rotation of the drill string 10 by the kelly 32. The sensed azimuthal position and rate of rotation, which will be referred to as the outputs of the gyro 20, are input to a microprocessor 22 which is located within the drill collar 12. As will be discussed in detail in subsequent sections, sequential gyro outputs form compatible commands used to control various downhole equipment 26 which is usually located within or alternately near the drill collar 12. As examples, the equipment 26 might include a sensor such as a nuclear, electromagnetic or acoustic sensor to measure physical properties of earth formation 53 penetrated by the drill bit 30. The equipment 26 can also comprise a mud motor which is well known in the art and is used in drilling boreholes which deviate from the vertical as discussed previously. The power supply 24 is illustrated as a power source for the equipment 26, but it should be understood that one or more additional power supplies are often used as separate sources of power for a plurality of downhole components.

Figure 2:
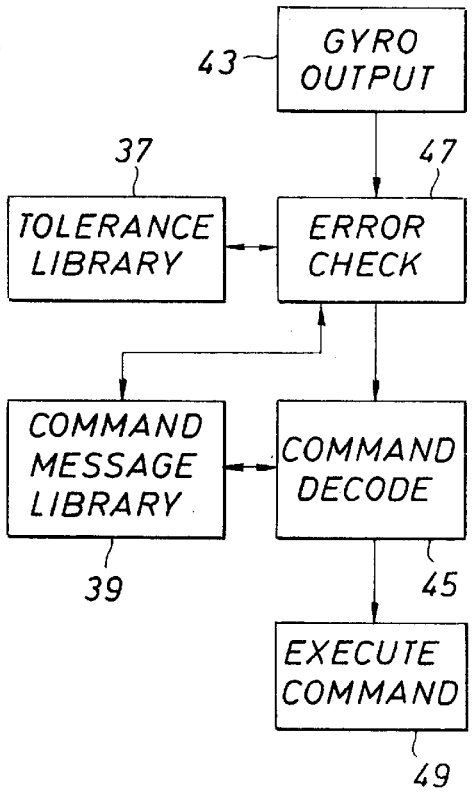
FIG. 2 is a functional diagram of the steps used to convert incremental angular rotations and angular rotational speed of a drill collar as detected by a single axis gyro.

Cooperation between the output of the gyro 20, the microprocessor 22 and the downhole equipment 26 is shown in the functional diagram in FIG. 2. Sequential gyro outputs 43 from the gyro 20 are input to the microprocessor 22 wherein they are first checked for error at the step 47. Error checks include determining if the measured gyro output 43 falls within tolerances which are stored preferably as a look up table or "tolerance library" stored within the microprocessor and denoted by the block 37. Error checking also includes determining if the sensed output sequence represents an acceptable message output pattern stored within a library 39 of command message patterns stored within the microprocessor 22. If the gyro output passes the error check criteria at step 47, the output pattern is then decoded as a specific message or command at step 45 by matching gyro output 43 with a specific message stored within the command message library 39. The comparison is performed within the microprocessor 22. Once the command message is identified, the microprocessor 22 outputs an appropriate, compatible execute command signal at step 49 to the equipment package 26 to perform or execute the command. The functional relationship between the elements of the apparatus as described in FIG. 2 is preferred, but it should be understood that other functional relationships can be used to operate the invention.

Attention is again directed to the apparatus shown in FIG. 1. Specific commands to operate downhole equipment 26 are transmitted from the surface 48 of the earth to the downhole equipment by means of rotating the drill string 10 in a sequential pattern. Rotation is accomplished preferably by rotating the kelly 32. The patterned rotation is sensed by the downhole gyroscope 20, the output of the gyroscope is interpreted by the microprocessor 22, and an appropriate command signal is then sent to the equipment 26. A plurality of transmission techniques can be used, with certain techniques offering advantages in specific drilling operations.

Figure 3A:
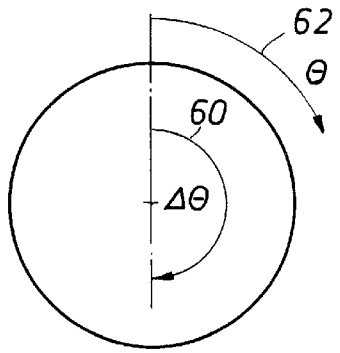
FIG. 3*a* illustrates successive incremental angular rotations in the same direction as a means for encoding data.

A first transmission method is based upon the rotation of the drill string through an angle $\Theta$ over a period of time in sequential increments of $\Delta\Theta$. FIG. 3*a* defines a clockwise rotation $\Theta$, identified by an arrow 62, of the drill string 10 in increments $\Delta\Theta$, identified by an arrow 60. In FIG. 3*a*, $\Delta\Theta=180°$. Other values of $\Delta\Theta$ can be used. $\Delta\Theta$ must, however, be sufficiently large such that a rotation of the kelly 32 through the increment $\Delta\Theta$ will result in a corresponding rotation of the drill collar 12 suspended by thousands of feet of drill string 10. A relatively small $\Delta\Theta$ of, say 5° would not be practical since friction between the drill string and the borehole wall combined with the twisting of the drill string might result in no downhole rotation of the drill collar 12. It is also highly desirable that the drill bit 30 not be engaged with the bottom of the borehole, but be lifted off bottom by a distance 40 to minimize twisting of the drill string. Conversely, $\Delta\Theta$ should not be excessively large in order to maximize the transmission rate.

Figure 3B:
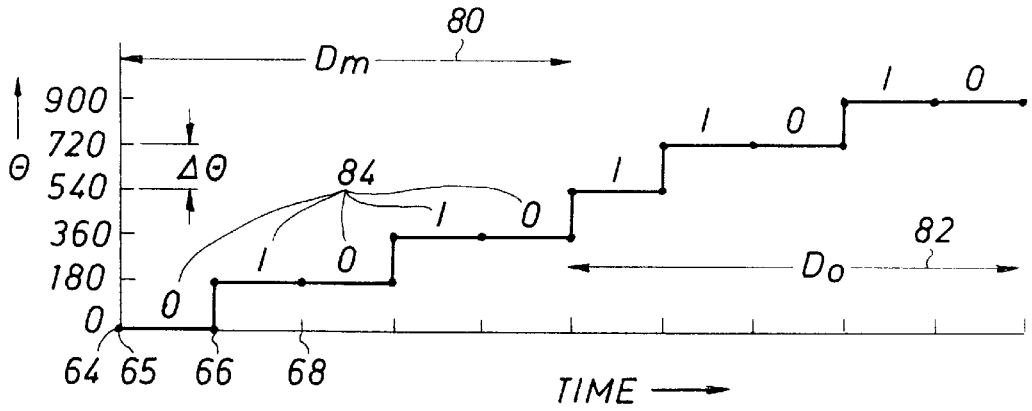
FIG. 3*b* illustrates incremental angular rotation as a function of time for binary transmission.

FIG. 3*b* is a plot of rotation angle $\Theta$ (ordinate) as a function of time (abscissa), and illustrates a hypothetical transmitted message using incremental rotations of $\Delta\Theta$=180°. Equal incremental rotations are preferred, but not required to operate the invention. Using this transmission technique, a rotation of $\Delta\Theta$=180° during a specified time interval represents a binary data bit 1, and no rotation over the reference time interval represents a binary data bit 0. Starting at a reference angle 64 of $\Theta$=0° and reference time 65 =0, there is no rotation during the time interval from 65 to time 66 therefore the first transmitted bit $\Delta\Theta_1$ is =0, where the subscript indicates the sequential time interval. The drill string is then rotated $\Delta\Theta_2$=180° during the second time interval from time 66 to time 68. This rotation is, therefore, sensed by the gyro 20 as a binary bit 1. During the next three time intervals, the drill string is not rotated, rotated 180° and not rotated ($\Delta\Theta_3$=0°, $\Delta\Theta_4$=180°, $\Delta\Theta_5$0°) which correspond to binary 0, 1, and 0, respectively. The first 5 bits, identified as a group by the numeral 84, which are generated sequentially during the time interval 80, represent a five bit binary message or command $D_m$=(0,1,0,1,0). It is preferred that additional overhead bits be transmitted with each message command. A five bit overhead word Do, transmitted sequentially during the time interval 82, is illustrated in FIG. 3*b* as $D_o$=(1,1,0,1,0). This overhead word preferably contains address and error information that will be discussed in the following section. Equal time intervals for the incremental rotations are preferred, but not required to operate the invention.

Figure 4A:
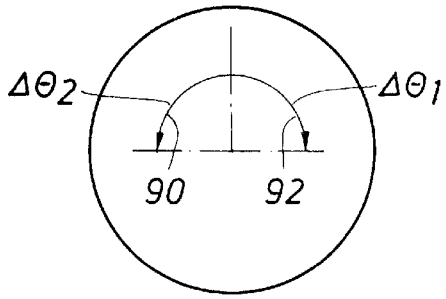
FIG. 4*a* illustrates successive incremental angular rotations in opposite directions as a means for encoding data.
Figure 4B:
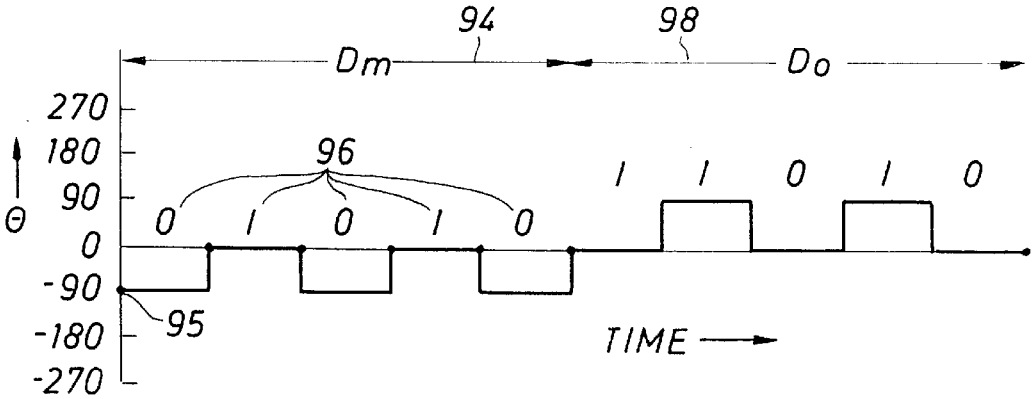
FIG. 4*b* illustrates incremental angular rotation in opposite directions as a means for transmitting binary data.

FIG. 4*a* illustrates an alternate transmission technique wherein the drill string is rotated in increments of $\Delta\Theta$=+90° and −90°, with $\Delta\Theta$=+90° representing a binary 1 and $\Delta\Theta$=−90° representing binary 0. FIG. 4*b* illustrates this transmission technique again as a plot of D as a function of time. Starting at an initial time 95, sequential rotations of ($\Delta\Theta_1$, . . . ,$\Delta\Theta_5$)=(−90°,+90°,−90°,+90°,−90°)during the time interval 94 produces the message word $D_m$=(0,1,0,1,0) as identified by the numeral 96. The overhead word generated during the time interval 98 is again $D_o$=(1,1,0,1,0).

Figure 5:
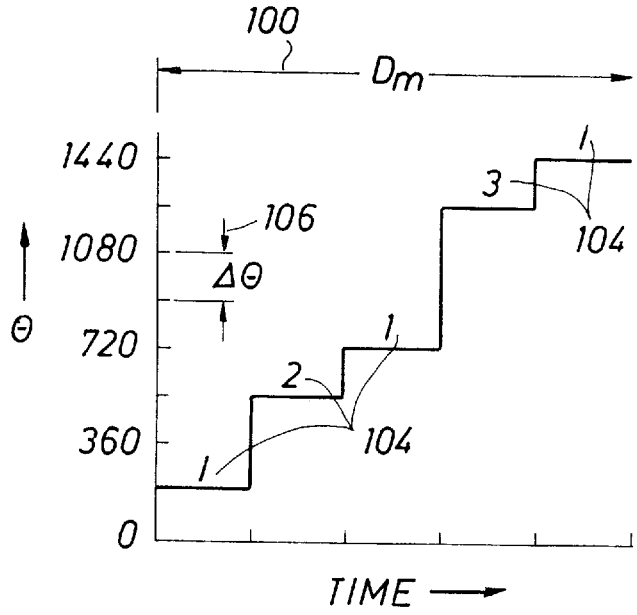
FIG. 5 illustrates incremental angular rotation in the same direction as a means for encoding non-binary data.

The incremental rotation technique is not limited to binary transmissions. FIG. 5 illustrates a technique in which the magnitude of the rotation angle is proportional to the magnitude of the transmitted bit. The transmission of a five bit message $D_m$ over the total time interval 100 is illustrated, and the overhead message $D_0$ has been omitted for brevity. FIG. 5 is again a plot of $\Theta$ versus time, and $\Delta\Theta$ is now defined as the minimum incremental angle of rotation. In the example shown in FIG. 5, $\Delta\Theta$=180° as denoted by the arrow 106. A rotation of $\Delta\Theta$ corresponds to the integer 1, a rotation of 2$\Delta\Theta$ corresponds to the integer 2, a rotation of 3$\Delta\Theta$ corresponds to the integer 3, and so forth. Stated mathematically, $$I=i\Delta\Theta \tag{1}$$

where I is defined as transmitted integers =1, 2, 3, . . . , and i=1, 2, 3, . . . . The example of FIG. 5 illustrates the transmission of a message word $D_m$ =12131 with a total drill string rotation of 1440°. The bits comprising the message word $D_m$ are denoted as a group by the numeral 104. Alternately, other angle increments can be used. As an example, if the angle increment is 270°, then $\Delta\Theta$=270° corresponds to the integer 1, $\Delta\Theta$=540° corresponds to the integer 2, and so forth. It is desirable to select the smallest value of $\Delta\Theta$ that will yield relatively error free transmission, in order to minimize transmission time as discussed previously. Furthermore a constant angle increment is preferred, but not required to operate the invention.

Figure 6:
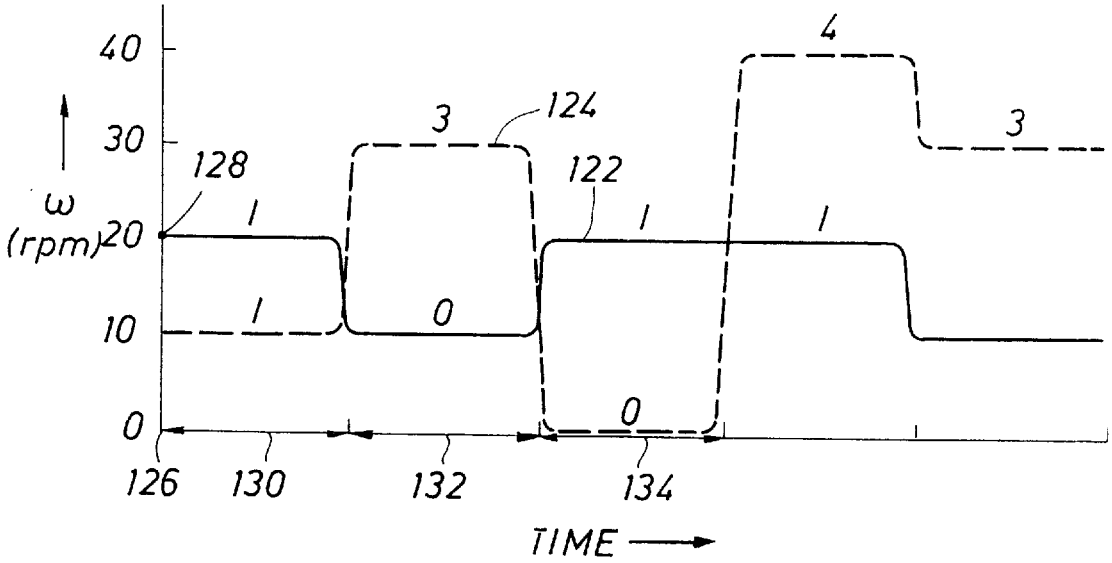
FIG. 6 shows angular speed as a function of time as a means for transmitting binary and non-binary data

The previous examples have illustrated incremental rotation angle transmission techniques. In deviated boreholes where frictional forces acting upon the drill string are large, incremental transmissions can be erroneous due to excessive twisting of the drill string. In these drilling situations, it is often advantageous to use variations in angular speed as a basis for data transmission. FIG. 6 illustrates examples of this method. Curve 122 represents the angular velocity $\omega$ (in revolutions per minute) of the drill string as a function of time. A value of $\omega$=20 rpm corresponds to a binary1, and a value of $\omega$=10 rpm corresponds to a binary 0. Starting at an initial time 126, the drill bit is rotated at 20 rpm. After some twisting of the drill string during start up, the drill collar 12 containing the gyro 20 also reaches an average rotation rate of 20 rpm. It is desirable to average the $\omega$ as sensed by the gyro over several revolutions during a time interval 130 in order to minimize error induced by the drill string "grabbing" the borehole wall and suddenly being released therefrom. The $\omega$=20 rpm sensed by the gyro indicates a binary 1. In the following time interval 132 the rotation rate is decreased to $\omega$=10 rpm indicating a binary 0, in the following time interval 134 $\omega$ is again increased to 20 rpm indicating a binary 1. This process is repeated over subsequent and preferably equal time intervals until the desired binary word is transmitted. In the example of curve 122, the five bit binary word is (1,0,1,1,0). It is again emphasized that error can be minimized by averaging each $\omega$ over several revolutions, after changing $\omega$, in order to minimize error induced by sticking or grabbing of the drill string. This technique is advantageous over the incremental rotation in overcoming this type or error and is, therefore, more suited for use in highly deviated boreholes.

Decimal messages can also be transmitted using the angular velocity method as illustrated with curve 124 of FIG. 6. A preferably constant incremental angular velocity $\Delta\omega$ is first selected. $\Delta\omega$=10 rpm is used in the example shown in FIG. 6. A rotation rate of $\omega$=10 rpm corresponds to the integer 1, a rotation rate of 2$\omega$=20 rpm corresponds to the integer 2, a rotation rate of 3$\omega$=30 rpm corresponds to the integer 3, and so forth. Stated mathematically, $$I=i\Delta\omega \tag{2}$$

where I is defined as transmitted integer=1, 2, 3, . . . , and i=1, 2, 3, . . . . The example of curve 124 in FIG. 6 illustrates the transmission of a message word $D_m$ =13043. As with the incremental angle rotation technique, other speed increments can be used. As an example, if the speed increment is 30 rpm, then $\omega$=30 rpm corresponds to the integer 1, $\omega$=60 rpm corresponds to the integer 2, and so forth. It is desirable to select the smaller angular velocity (taking into account defined error limits) in order to minimize data transmission time, since more time is required for the drill collar to make a larger angular velocity change. Once again, it is emphasized that error can be minimized by averaging each $\omega$ over several revolutions, after changing $\omega$, in order to minimize error induced by sticking or grabbing drill string. This technique is advantageous over the previously discussed incremental rotation in overcoming this type or error and is, therefore, more suited for use in highly deviated boreholes. Dependant on many factors, it may be advantageous to use a higher angular velocity as the elapsed time is reduced for a given number of rotations.

Using either the angular position or angular speed coding embodiment of the invention, a reasonable baud rate using transmission for acceptable error limits is about one symbol every 30 sec. A short command word consisting of 5 useful bits (e.g. a specific device command) and 5 overhead bits (e.g. a device identifier and/or address and/or error) can, therefore, be transmitted in about 5 min.

If there were no frictional forces acting between the drill string and the borehole wall, incremental rotations or angular velocity rotations of the drill string at the surface would be reflected in the same rotations at the drill collar, and these rotations sensed by the gyro would contain no drill string "twisting" related error. These frictional forces are, however, present. Transmitted command messages using techniques of this invention are therefore monitored for such error. Transmitted command messages must also be monitored to insure that commands are valid, and that erroneous commands have not been transmitted form the surface. If twisting related errors outside predetermined limits are sensed, the transmitted command is not executed. Furthermore, if unrecognizable commands are sensed, no commands can be executed.

The detection of drill pipe twisting induced error will first be addressed. There are several criterion that can be used to detect this type of error, and these criterion vary depending upon whether the incremental angle technique or the angular speed technique is used to transmit. With any data transmission system, both error detection and error correction in the telemetry can be implemented. These are discussed in many texts, one example being the book "Coding and Information Theory: by R. W. Hamming and published by Prentice-Hall, Inc.

One aspect of error correction consists of checking the message received by the gyro against a library of valid messages as shown functionally at step 47 in FIG. 2. Defining a message as a selected number of bits (typically 4 to 12 bits), error check protocols are known which add one or two bits, changing word length, to provide error check bits for enhanced reliability (see Hamming for example).

The foregoing discloses means and apparatus for transmitting commands to a downhole apparatus by rotating the drill string at the surface. Rotation can be incremental angular rotations, or rotations at differing angular speeds. Drill pipe rotations are sensed by a single axis gyro within the downhole package and input into a downhole microprocessor for interpretation and command implementation. Errors due to twisting of the drill string, and errors due to erroneous commands are measured downhole using the downhole processor and established error limits and message libraries.

While the foregoing is directed to the preferred embodiment of the invention, the scope thereof is determined by the claims which follow.

What is claimed is:

1. A method for transmitting data to a borehole device affixed to a drill pipe, comprising:

(a) representing said data by a controlled rotation of said drill pipe;

(b) sensing said rotation with a gyroscope having at least one axis; and (c) decoding said sensed rotation into said transmitted data.

2. The method of claim 1 including the step of positioning said gyroscope in a drill collar above a drill bit.

3. The method of claim 2 comprising the additional steps of:

(d) inputting said sensed rotation into a computer within said drill collar;

(e) decoding said sensed rotation into said transmitted data at said computer; and (f) from said decoded sensed rotation, forming a command signal representative of said transmitted data.

4. The method of claim 3 comprising the additional step of operating downhole equipment responsive to said command signal.

5. The method of claim 4 comprising the additional step of rotating said drill pipe through a plurality of controlled rotations thereby forming a word representing said transmitted data.

6. The method of claim 5 wherein said word is organized into a command message and an error message.

7. The method of claim 1 wherein said controlled rotation comprises one or more incremental rotations through a predefined increment angle.

8. The method of claim 1 wherein said controlled rotation comprises rotation at one or more predefined rotation speeds.

9. The method of claim 1 wherein the gyroscope has a single axis and is positioned with the axis of the gyroscope in an X-Y plane.

10. The method of claim 1 wherein the gyroscope has a single axis and an initial reference location is defined at one angle with respect an axis of the drill pipe.

11. The method of claim 1 including the step of sensing rotation of the drill pipe with respect to at least two gyroscope axes.

12. The method claim 11 wherein the least two gyroscope axes are located at nonright angles with respect to an axis of the drill pipe.

13. A method for controlling, from the surface of the earth, downhole equipment attached to a drill string, comprising the steps of:

(a) providing means at an upper end of said drill string at the surface of the earth for controllably rotating said drill string;

(b) controllably rotating said drill string to define a command;

(c) sensing drill string rotation with a gyroscope having at least one axis located in a drill collar at a lower end of said drill string within a borehole, wherein a selected axis of said gyrosope is positioned at a known angular relationship with said drill collar;

(d) decoding, within said drill collar, said sensed rotation into a signal representative of said command; and (e) operating said equipment in response to said signal.

14. The method of claim 13 wherein said drill string is sequentially controllably rotated thereby defining a transmitted word comprising said command and an error associated with the transmission of said command.

15. The method of claim 14 comprising the additional steps of:

(f) providing a microprocessor within said drill collar which cooperates with said gyroscope; and (g) operating said microprocessor to (i) determine if said error is less than a predetermined allowable error, (ii) decode said sensed rotations into a signal representative of said command, and (iii) if said error is less than said allowable error, transmit said command from said microprocessor to operate said equipment.

16. The method of claim 13 wherein said controlled rotation comprises one or more incremental rotations through a predefined increment angle.

17. The method of claim 13 wherein said controlled rotation comprises rotations at one or more predefined rotation speeds.

18. An apparatus for transmitting data to a borehole device affixed to a drill pipe, comprising:

(a) means for controllably rotating said drill pipe representative of said data;

(b) a gyroscope having at least one axis for sensing said rotations; and (c) means for decoding said sensed rotations into said transmitted data.

19. The apparatus of claim 18 wherein:

said gyroscope is mounted within a drill collar affixed to said drill pipe in the vicinity of a drill bit; and said at least one axis of said gyroscope is parallel to a major axis of said drill collar.

20. The apparatus of claim 19 further comprising a microprocessor within said drill collar, wherein:

said sensed rotations are decoded into said transmitted data; and a command signal, representative of said transmitted data, is formed to operate downhole equipment.

21. The apparatus of claim 20 wherein said drill string is rotated through a plurality of controlled rotations thereby forming a word of transmitted data comprising said command and an error message.

22. The apparatus of claim 18 wherein said controlled rotation comprises one or more incremental rotations through a predefined increment angle.

23. The apparatus of claim 18 wherein said controlled rotation comprises rotations at one or more predefined rotation speeds.

* * * * *